US006965346B2

(12) United States Patent
Sung et al.

(10) Patent No.: US 6,965,346 B2
(45) Date of Patent: Nov. 15, 2005

(54) WIRELESS LAN ANTENNA AND WIRELESS LAN CARD WITH THE SAME

(75) Inventors: Jae Suk Sung, Kyungki-do (KR); Hee Chan Park, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 15 days.

(21) Appl. No.: 10/673,265

(22) Filed: Sep. 30, 2003

(65) Prior Publication Data

US 2004/0125030 A1 Jul. 1, 2004

(30) Foreign Application Priority Data

Dec. 16, 2002 (KR) ..... 10-2002-0080250
Jun. 24, 2003 (KR) ..... 10-2003-0041171

(51) Int. Cl.[7] ..... H01Q 1/24
(52) U.S. Cl. ..... 343/702; 343/700 MS
(58) Field of Search ..... 343/702, 700 MS, 343/846, 848, 829, 873; H01Q 1/24

(56) References Cited

U.S. PATENT DOCUMENTS 6,366,243 B1 4/2002 Isohatala et al.
6,448,933 B1 9/2002 Hill et al.
6,677,905 B2 * 1/2004 Deguchi et al. ..... 343/702
6,717,548 B2 * 4/2004 Chen ..... 343/700 MS
6,720,925 B2 * 4/2004 Wong et al. ..... 343/700 MS
6,768,460 B2 * 7/2004 Hoashi et al. ..... 343/700 MS
6,806,834 B2 * 10/2004 Yoon ..... 343/702
2002/0075190 A1 6/2002 Ghosh et al. ..... 343/702
2003/0206136 A1 * 11/2003 Chen ..... 343/702

FOREIGN PATENT DOCUMENTS

DE 100 49 845 10/2000
EP 0 766 340 4/1997
JP 2002-28803 A 4/2002

OTHER PUBLICATIONS

David M. Pozar, "Microwave Engineering", Addison–Wesley Publishing Company, 1990, Kapitel 6.3, Chapter 6: Impedance Matching and Tuning, pp. 296 and 297.

* cited by examiner

*Primary Examiner*—Hoanganh Le
(74) *Attorney, Agent, or Firm*—Lowe, Hauptman & Berner, LLP

(57) ABSTRACT

A wireless LAN antenna/card which can transmit/receive RF signals in a high frequency band (e.g., 5 GHz) and a low frequency band (e.g., 2.4 GHz), includes a radiation electrode, a matching electrode and a feeding electrode. The radiation electrode has a predetermined area to define a transmission/reception frequency band of the antenna. The matching electrode has at least one open stub. The feeding electrode has a feeding point formed at an arbitrary position of the feeding electrode to receive a current, a first end connected to the radiation electrode, and a second end connected to the matching electrode. Further, the feeding point and a ground point are arbitrarily set on the feeding electrode, thus adjusting the impedance and frequency of the wireless LAN antenna.

3 Claims, 10 Drawing Sheets

WIRELESS LAN ANTENNA AND WIRELESS LAN CARD WITH THE SAME

BACKGROUND OF THE INVENTION

1. Field of the Invention

The present invention relates generally to antennas provided within a wireless local area network, and more particularly to a wireless local area network antenna and wireless local area network card implemented using the same, which can transmit/receive RF signals in a high frequency band (5 GHz) and a low frequency band (2.4 GHz) without increasing the size of the antenna, and simply adjust antenna characteristics without varying the structure of the antenna.

2. Description of the Related Art

Recently, with the miniaturization and weight reduction of mobile communication devices, and the multiplexing of a transmission/reception band to two or more bands, an antenna, one of important parts for the wireless transmission/reception of a mobile communication terminal, has been developed to an F or inverted F-type antenna from an external helical antenna.

Especially, in the case of a wireless Local Area Network (LAN), a dual band antenna capable of transmitting/receiving data in a 5 GHz frequency band as well as a currently used 2.4 GHz frequency band is required to enable large capacity data, such as multimedia data, to be transmitted afterward.

FIG. 1 is a view showing a conventional dual band antenna. As shown in FIG. 1, an antenna 11 comprises a radiation electrode 13 with a predetermined area, a slot 14 positioned in the radiation electrode 13 to multiplex a current path of the radiation electrode 13, a feeding electrode 16 for applying a current to the radiation electrode 13, and a ground electrode 15 for grounding the radiation electrode 13.

In FIG. 1, one slot 14 forms two current paths connected in parallel on the radiation electrode 13 on the basis of the feeding electrode 16, thus causing resonance to occur in two frequency bands corresponding to the respective current paths. Further, the two frequency bands in which resonance occurs are the transmission/reception bands of a corresponding antenna. Therefore, the two transmission/reception bands are determined by the areas of two radiation regions divided by the slot 14 of the radiation electrode 13.

The antenna shown in FIG. 1 is called a Planar Inverted F-type antenna (PIFA) according to the shape thereof. Besides the PIFA, a monopole-type antenna, having no ground electrode in the structure of FIG. 1, is also used.

However, if the conventional dual band antenna as shown in FIG. 1 is applied to a wireless LAN, there may be limitations in the height, length, area and the like of the antenna due to the size of the wireless LAN antenna.

In detail, the radiation electrode 13 of the antenna must be positioned farthest from a ground surface of a Printed Circuit Board (PCB) and the area thereof must be large so as to allow the antenna having the structure of FIG. 1 to have a suitable center frequency and to realize required impedance matching. However, most wireless LAN products recently developed are formed in a card shape, like a Personal Computer Memory Card International Association (PCMCIA) card and a Compact Flash (CF) card. Therefore, a maximum height between the radiation electrode and the ground surface of the antenna is limited.

Therefore, in the case of a dual band wireless LAN antenna, satisfactory transmission/reception characteristics cannot be obtained in 2.4 GHz and 5 GHz frequency bands due to the limitations of the height and area of the antenna.

FIG. 2 is a graph showing the characteristics of a dual band wireless LAN antenna for 2.4 GHz/5 GHz frequency bands, implemented using the conventional structure.

Referring to the graph of FIG. 2, it can be seen that a Voltage Standing Wave Ratio (VSWR) curve forms valleys that have narrow widths and, thus, are sharp in the 2.4 GHz and 5 GHz frequency bands in the conventional dual band wireless LAN antenna. In terms of frequency bands between markers P1 and P2 and between markers P3 and P4, there is a problem in that, since VSWR values in the 2.4 GHz frequency band are greater than two, signal characteristics of the 2.4 GHz frequency band are degraded. In terms of signal characteristics, there is a problem in that, since a bandwidth in the 2.4 GHz frequency band satisfying a VSWR value equal to or less than two is narrow, antenna characteristics are easily deviated depending on the variation of sets or surrounding environments.

In order to solve the problems, the area of the radiation electrode must be widened or the distance between the radiation electrode and the ground must be increased, as described above. However, in this case, there is a problem in that the size of the antenna increases. Consequently, it is difficult to apply the antenna to the card-shaped wireless LAN products.

SUMMARY OF THE INVENTION

Accordingly, the present invention has been made keeping in mind the above problems occurring in the prior art, and an object of the present invention is to provide a wireless LAN antenna and wireless LAN card implemented using the same, which can satisfy antenna characteristics of high and low frequency bands without increasing the size of the antenna, and simply adjust antenna characteristics without varying the structure thereof.

Another object of the present invention is to provide a dual band wireless LAN antenna, which can realize impedance matching and adjust a resonance frequency by varying only a feeding position without modifying the structure or pattern of the antenna.

A further object of the present invention is to provide a dual band wireless LAN antenna, in which an antenna type can easily vary from a monopole-type antenna to an inverted F-type antenna without varying the pattern shape or structure of the antenna, thus suitably and promptly coping with the variation of sets.

In order to accomplish the above and other objects, the present invention provides a wireless Local Area Network (LAN) antenna, comprising a radiation electrode with a predetermined area for determining at least one transmission/reception frequency band of the antenna; a matching electrode having at least one open stub; and a feeding electrode having a feeding point formed at an arbitrary position of the feeding electrode to receive a current, with a first end connected to the radiation electrode and a second end connected to the matching electrode.

Preferably, the wireless LAN antenna further comprises at least one slot for dividing the radiation electrode into two or more regions to form current paths connected in parallel based on the feeding electrode.

Preferably, the wireless LAN antenna is designed so that impedance matching thereof is adjusted by adjusting a length of the open stub of the matching electrode.

Preferably, the wireless LAN antenna is designed so that a resonance frequency and impedance matching thereof is adjusted by adjusting a position of the feeding point on the feeding electrode.

Preferably, in the wireless LAN antenna, a ground point can be further formed on the feeding electrode, and an antenna type can vary from a monopole-type antenna to an inverted F-type antenna depending on whether the ground point is formed.

In addition, the present invention provides a wireless Local Area Network (LAN) card, comprising a printed circuit board on which a plurality of semiconductor chips and devices are mounted to process RF LAN signals; and first and second antennas each designed so that a radiation electrode with a predetermined area for determining at least one transmission/reception frequency band of each antenna is printed on a top surface of a hexahedral dielectric block, a matching electrode having at least one open stub is printed on a front surface of the dielectric block so as not to directly come into contact with the radiation electrode, and a feeding electrode having a first end connected to the radiation electrode and a second end connected to the matching electrode is printed on back and bottom surfaces of the dielectric block, the first and second antennas being mounted on the printed circuit board to be perpendicularly arranged; and wherein impedance matching of the first and second antennas can be adjusted by adjusting the feeding points on the feeding electrodes when the first and second antennas are mounted on the printed circuit board.

In addition, the present invention provides a wireless Local Area Network (LAN) card, comprising a printed circuit board on which a plurality of semiconductor chips and devices are mounted to process RF LAN signals; an antenna support member fixed to a predetermined position of the printed circuit board to allow the antenna support member to be spaced apart from the printed circuit board by a certain height; and first and second antennas each comprising a radiation electrode with a predetermined area for determining at least one transmission/reception frequency band of the antenna, a matching electrode provided with at least one open stub, and a feeding electrode provided with a first end connected to the radiation electrode, a second end connected to the matching electrode, and a feeding point formed at an arbitrary position of the feeding electrode to receive a current, the radiation electrodes of the first and second antennas being supported by the antenna support member to be perpendicular to each other, and feeding electrodes thereof being soldered at predetermined positions of the printed circuit board; and wherein impedance matching of the first and second antennas can be adjusted by adjusting the feeding points on the feeding electrodes when the first and second antennas are mounted on the printed circuit board.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings.

Figure 3:
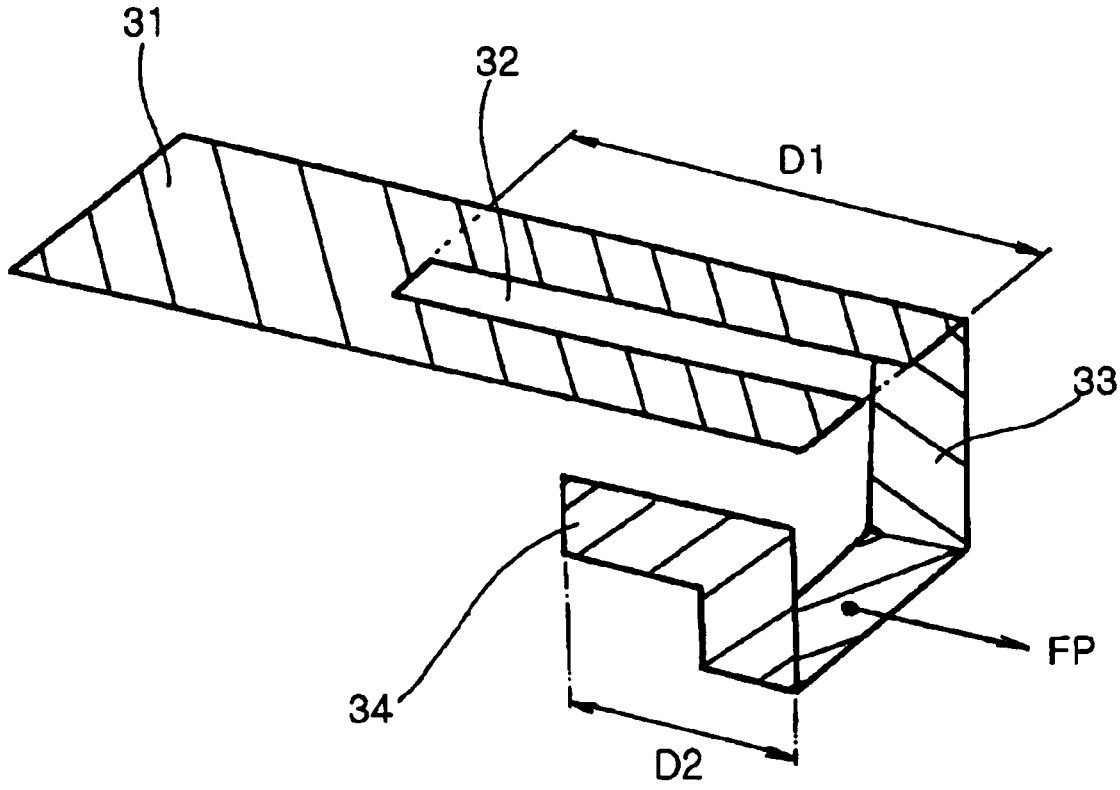
FIG. 3 is a perspective view of a dual band antenna according to the present invention.

FIG. 3 is a perspective view of a dual band wireless LAN antenna according to an embodiment of the present invention.

Referring to FIG. 3, the dual band wireless LAN antenna of the present invention comprises a radiation electrode 31 with a predetermined area for determining at least one transmission/reception frequency band of the antenna, a slot 32 for dividing the radiation electrode 31 to have two current paths connected in parallel from a feeding point FP, a feeding electrode 33 having one end connected to a certain portion of the radiation electrode 31 and having the feeding point FP formed to receive a current at an arbitrary position thereof, and a matching electrode 34 connected to the other end of the feeding electrode 33 and provided with at least one open stub spaced apart from the radiation electrode 31 by a predetermined distance.

The antenna having the above structure can be implemented in such a way that the electrodes are printed on respective surfaces of a dielectric block made of dielectric ceramic or polymer volume with a certain. Alternatively, the antenna can be implemented in such a way that the electrodes are formed by a press and then supported by a certain support member (for example, made of plastic or polymer and fixed to a PCB) to maintain the shape of FIG. 3.

As described above, in the antenna according to the present invention, antenna characteristics are influenced by the areas, distances and heights of the radiation electrode 31, the slot 32, the feeding electrode 33 and the matching electrode 34, regardless of the method in which the antenna is inplemented.

Similar to this, the radiation electrode 31, the feeding electrode 33 and the matching electrode 34 can be formed by printing a conductive material, such as Ag or Cu paste, on the surface of the dielectric block using a screen printing or other methods and then heat treating the dielectric block with the conductive material printed thereon. Further, they can be formed using plating or other methods. Further, the electrodes 31, 33 and 34 can be implemented so that an Ag or Cu plate or other conductive electrodes are cut in the shape shown in FIG. 3 and then attached to the surfaces of the dielectric block, or then supported by a support member positioned on the PCB.

The antenna can be designed in such a way that the electrodes 31, 33 and 34 can be directly formed on the PCB without using the support member as another method.

Further, the slot 32 serves to form on the radiation electrode 31 two or more paths through which a current input from the feeding point FP flows and which are connected in parallel. The slot 32 generates different resonance frequencies depending on the electrical lengths of the respective radiation regions. Therefore, the slot 32 is not necessary in the case where a single frequency band is required in a corresponding antenna. Further, the slot 32 can be formed to be plural depending on frequency bands in the case where two or more frequency bands are required in a corresponding antenna.

The embodiment of FIG. 3 shows a wireless LAN antenna capable of transmitting/receiving data in 2.4 GHz and 5 GHz dual bands. In the wireless LAN antenna, one slot 32 is formed and resonance occurs in two bands depending on the electrical lengths of the two regions of the radiation electrode 31 divided by the slot 32. That is, provided that the area of the radiation electrode 31 remains unchanged, resonance bands vary depending on the length D1 of the slot 32. That is, as the length D1 of the slot 32 increases, a current path lengthens in proportion to the length D1, and thus, all resonance frequency bands are lowered. On the contrary, as the length D1 of the slot 32 decreases, a current path shortens, and thus all resonance frequency bands are raised. That is, through the adjustment of the length D1 of the slot 32, resonance frequencies in both low and high frequency bands can be adjusted together.

The shapes of the radiation electrode 31 and the slot 32 are not limited to those of FIG. 3. Any common shape can be used for the radiation electrode 31 and the slot 32.

Further, the matching electrode 34 is a means for adjusting the impedance matching of the antenna, which is formed in an inverted and reversed L shape with one end connected to the radiation electrode 31 through the feeding electrode 33 and the other end adapted to form an open stub. The impedance of the antenna is adjusted depending on the length D2 of the open stub.

In detail, if the length D2 of the open stub increases, an impedance circle of a corresponding antenna enlarges and causes the antenna impedance to decrease. On the contrary, if the length D2 thereof decreases, the antenna impedance increases. Therefore, the impedance matching of the antenna can be realized by the matching electrode 34.

Further, the frequency and band characteristics of the antenna can be adjusted together by adjusting the length D1 of the slot 32 and the length D2 of the open stub of the matching electrode 34 together.

The embodiment of FIG. 3 shows an example of a basic structure of the wireless LAN antenna of the present invention. In the structure, the number and shape of both the slot 32 and the open stub of the matching electrode 34 can vary, and optimal antenna design values can be obtained from the variations.

Figure 7:
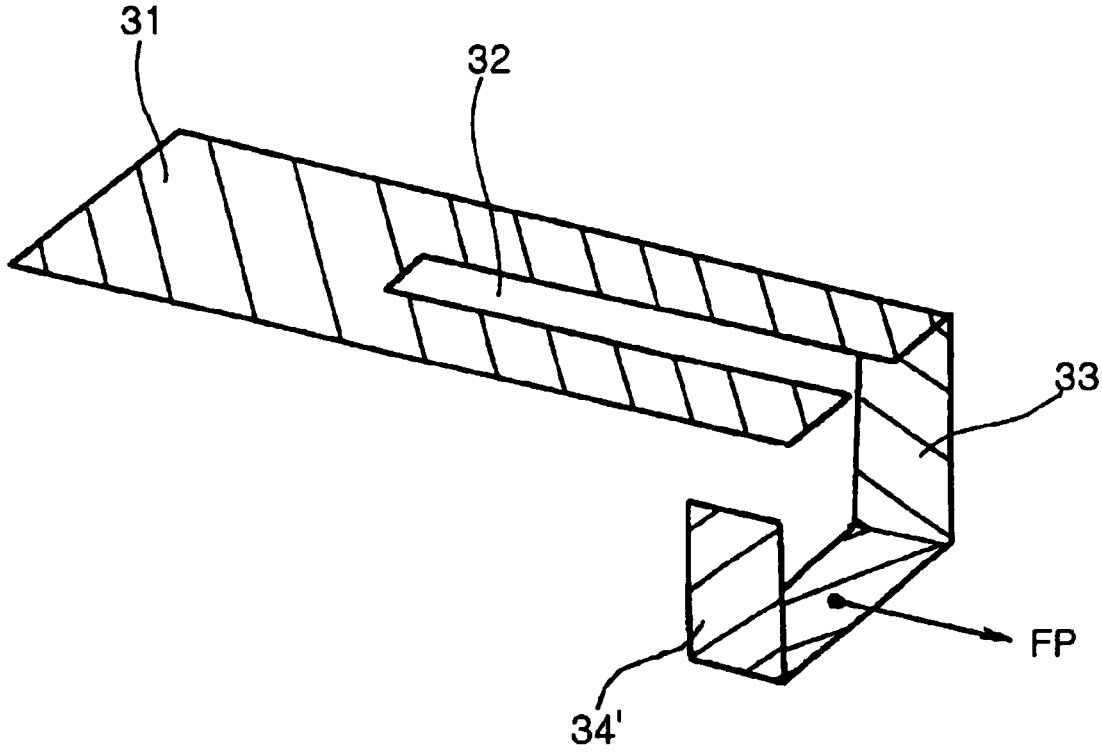
FIG. 7 is a perspective view showing another modified embodiment of the dual band antenna of the present invention.

For example, FIG. 7 shows a modified embodiment of the wireless LAN antenna of the present invention in which a projected "-" part is removed from the inverted and reversed L-shaped open stub. In this embodiment, a matching electrode 34' is formed in a bar shape, and impedance matching at this time is realized by adjusting the length (that is, height) of the matching electrode 34'.

Figure 8:
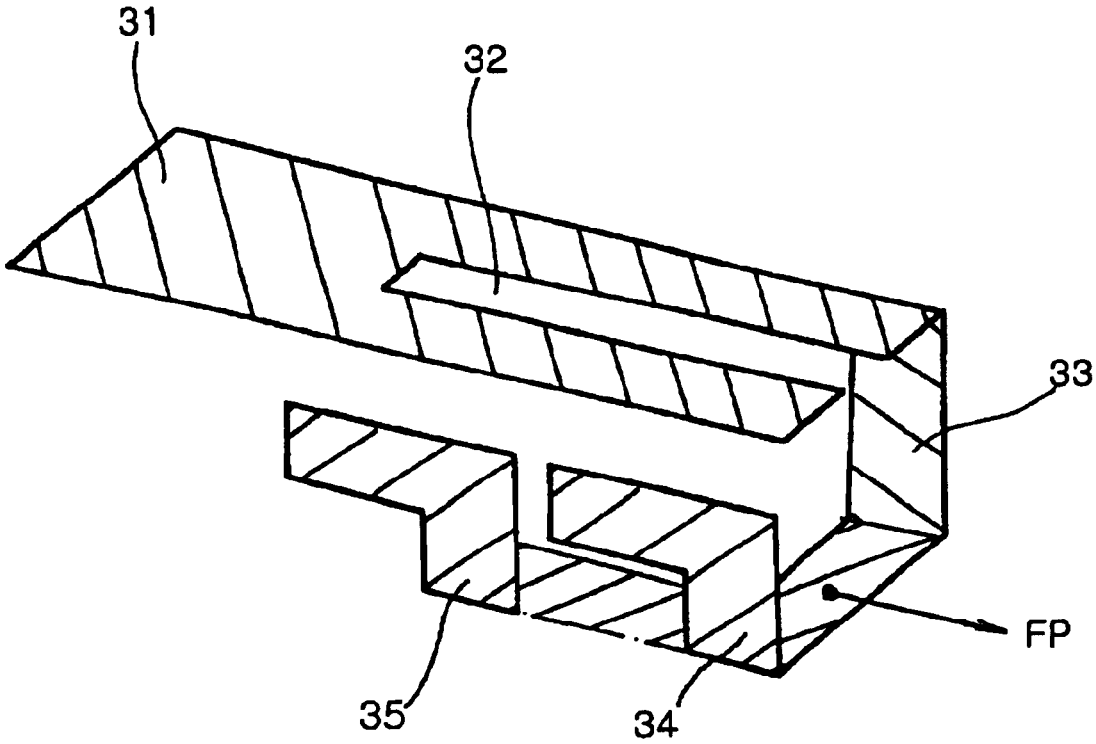
FIG. 8 is a perspective view showing a further modified embodiment of the dual band antenna of the present invention.

FIG. 8 shows another modified embodiment of the wireless LAN antenna of the present invention, wherein the wireless LAN antenna having a plurality of open stubs is depicted. As shown in FIG. 8, the wireless LAN antenna of the present invention may further comprise two matching electrodes 34 and 35 connected in parallel to one end of the feeding electrode 33. At this time, impedance depends on the sum of the lengths of the open stubs of the two matching electrodes 34 and 35. The number of matching electrodes 34 and 35 can increase if necessary.

Further, such a modification of the matching electrodes 34 and 35 can be performed if necessary.

Figure 4:
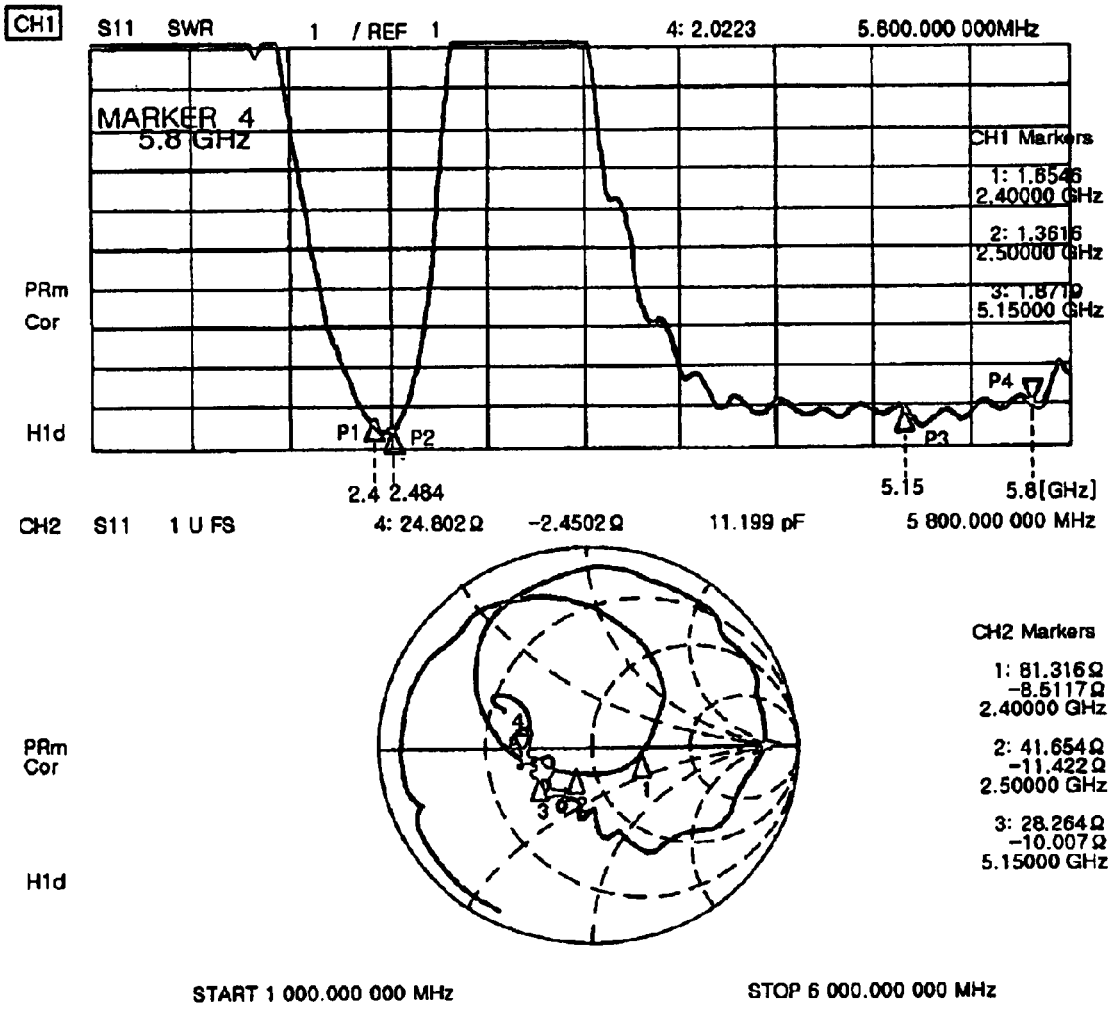
FIG. 4 is a graph showing the characteristics of the dual band antenna according to the present invention.

FIG. 4 is a graph showing VSWR values measured by the dual band wireless LAN antenna operating in 2.4 GHz and 5 GHz dual bands after the antenna is implemented as shown in FIG. 3. In this case, the size of the antenna was set to be equal to that of the conventional antenna measured in FIG. 2.

Figure 1:
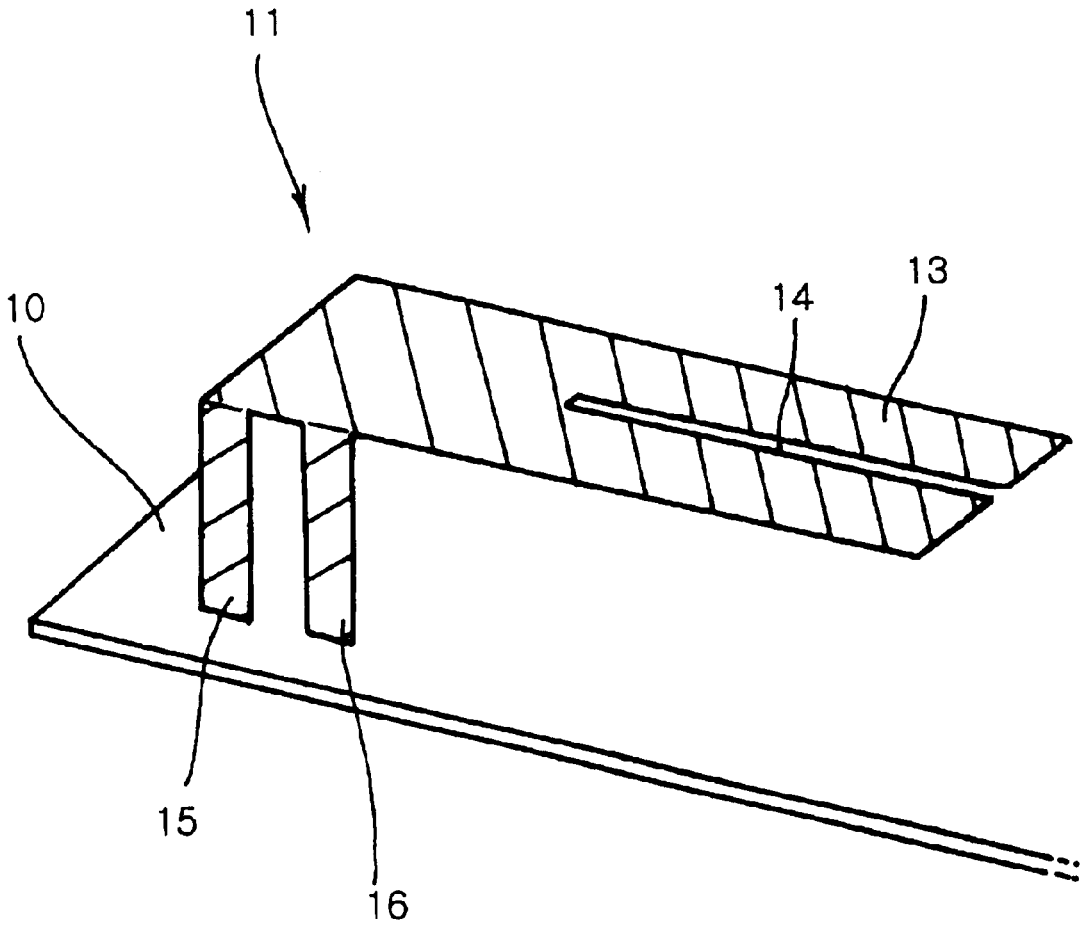
PRIOR ART FIG. 1
FIG. 1 is a perspective view of a conventional dual band antenna.
Figure 2:
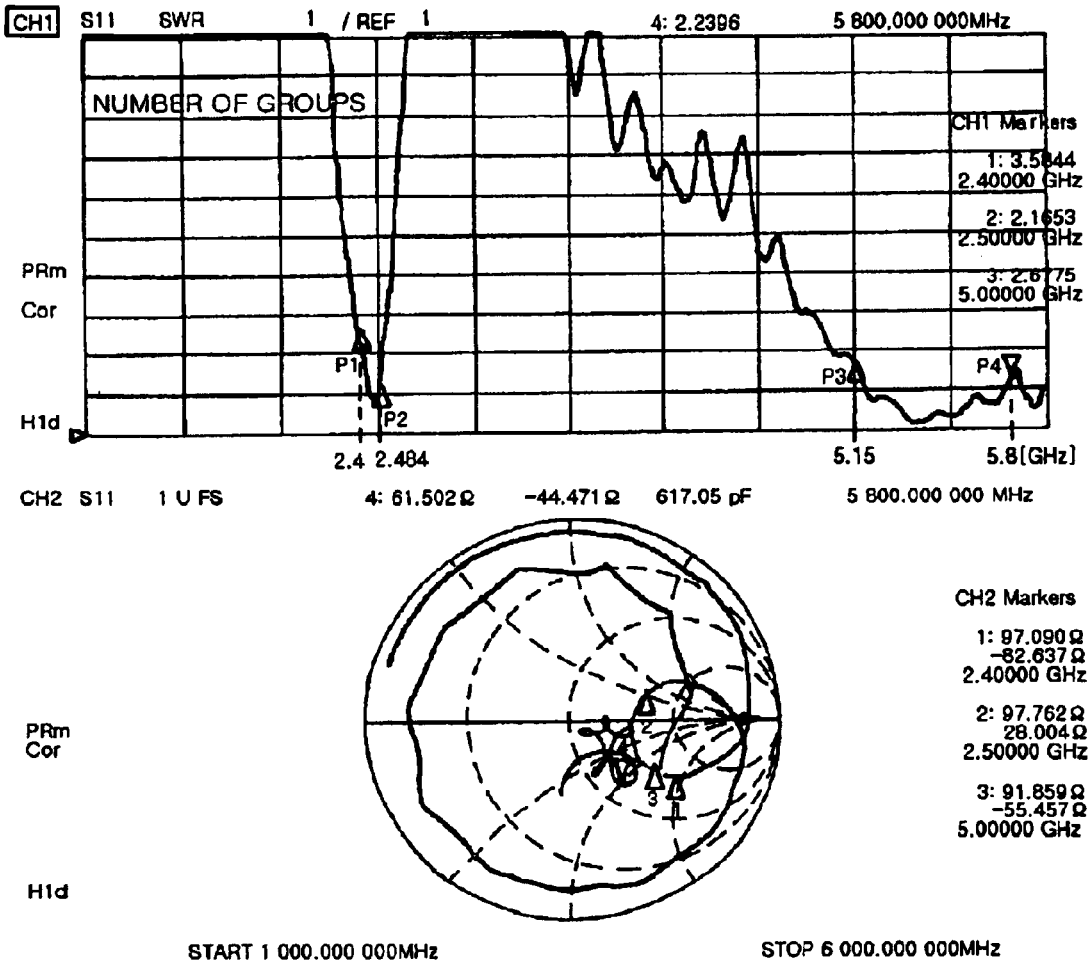
PRIOR ART FIG. 2
FIG. 2 is a graph showing the characteristics of the conventional dual band antenna.

If the measured values of FIG. 4 are compared with the conventional measured values of FIG. 2, the conventional antenna exhibits relatively high VSWR values in the band between 2.4 and 2.484 GHz corresponding to markers P1 and P2, respectively. On the contrary, the antenna of the present invention exhibits VSWR values equal to or less than two in a band wider than the band between 2.4 and 2.484 GHz corresponding to the markers P1 and P2, respectively.

Generally, as a resonance frequency band satisfying VSWR values is widened, an antenna can show stable, high performance without deviating antenna characteristics due to the variation of sets and surrounding environments. The conventional wireless LAN antenna is disadvantageous in that, since antenna characteristics easily deviate depending on sets and surrounding environments in the 2.4 GHz frequency band, the antenna cannot satisfy required performance. On the contrary, the wireless LAN antenna of the present invention is advantageous in that it shows wide bandwidth characteristics in the two frequency bands, thus obtaining stable characteristics against the variation of the sets and surrounding environments.

Further, the antenna of the present invention showed VSWR values lower than those of the conventional antenna even in the 5 GHz frequency band (band between markers P3 and P4). From the low VSWR values, the dual band wireless LAN antenna of the present invention can obtain good signal characteristics in both the 2.4 GHz and 5 GHz frequency bands.

Further, the wireless LAN antenna of the present invention can realize impedance matching by varying the position of the feeding point FP which receives a current on the feeding electrode 33, that is, comes into contact with an external circuit, without adjusting the length of the open stub of the matching electrode 34 or the length of the slot 32.

Figure 5A:
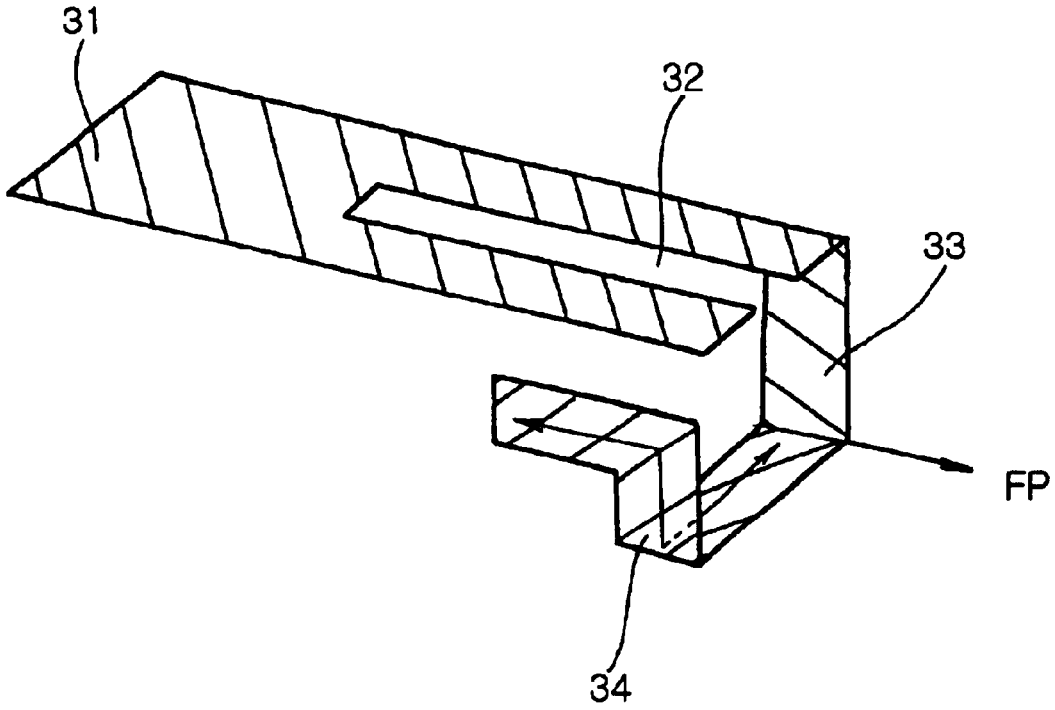
FIGS. 5A and 5B are views showing examples in which a feeding position is varied in the dual band antenna of the present invention.
Figure 5B:
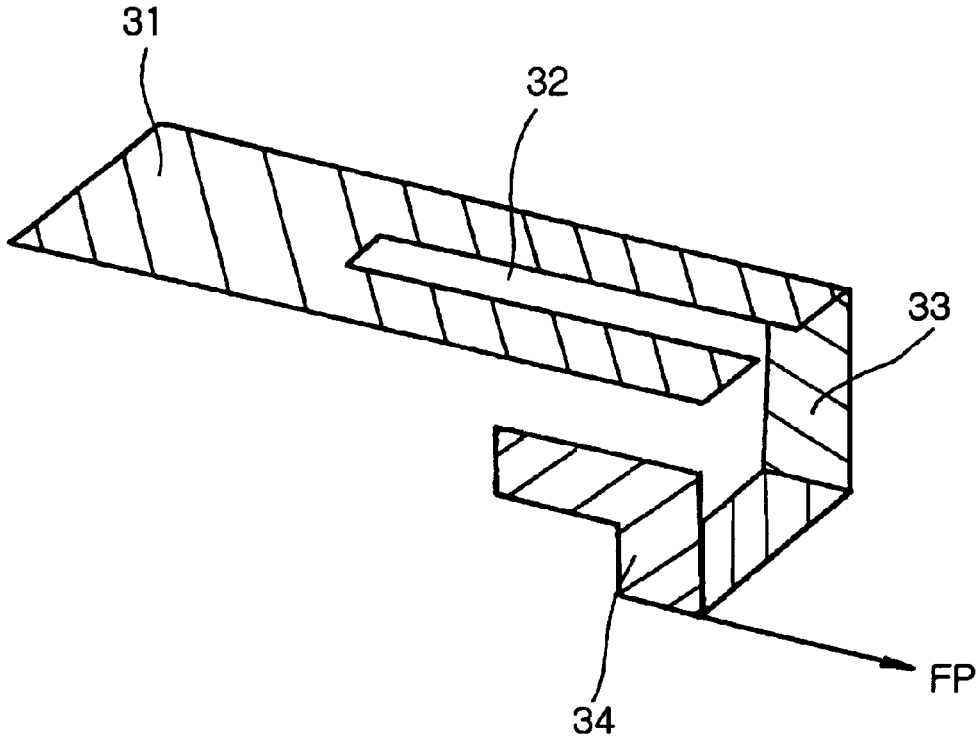

FIGS. 5A and 5B are examples showing that the position of the feeding point FP varies in the wireless LAN antenna of FIG. 3. FIG. 5A illustrates a case where the feeding point FP is moved to a side of the radiation electrode 31 in the wireless LAN antenna of FIG. 3. In this case, the effect of relative lengthening the open stub of the matching electrode 34 can be obtained. That is, the length of the open stub of the matching electrode 34 increases in proportion to the moving distance of the feeding point FP to the side of the radiation electrode 31. As a result, the impedance of the antenna can be adjusted to be decreased (that is, to increase an impedance circle). Further, since the feeding point FP is moved to a side of the radiation electrode 31 from a position of the radiation electrode 31, there is an advantage in that a current path relatively shortens, thus moving a center frequency of a resonance band to a higher frequency.

Next, FIG. 5B illustrates a case where the feeding point FP is moved to a side of the matching electrode 34 in the wireless LAN antenna of FIG. 3. In this case, a current path lengthens, and the open stub shortens, contrary to the case of FIG. 5A, thus adjusting the antenna impedance to be increased and moving a center frequency of a resonance band to a lower frequency.

Therefore, in the wireless LAN antenna of the present invention, optimal antennas can be easily implemented according to sets by varying the impedance and center frequency of the antenna together through the variation of only the position of the feeding point FP.

Further, in the wireless LAN antenna of the present invention, an antenna type can be changed from a monopole-type antenna to an inverted F-type antenna.

Figure 6:
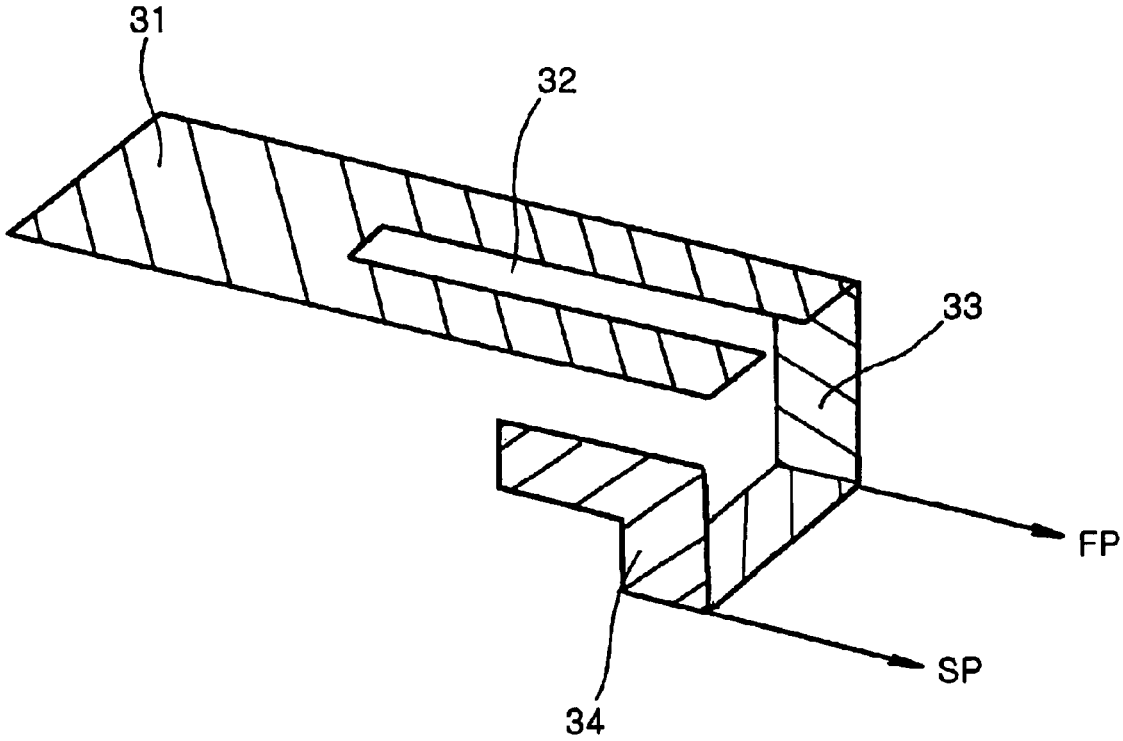
FIG. 6 is a view showing an embodiment in which the dual band antenna of the present invention is modified to an inverted F-type antenna.

As described above, the inverted F-type antenna is designed so that a radiation electrode is grounded through one portion while receiving a current through another portion thereof. Therefore, both a feeding point and a ground point are present together in the inverted F-type antenna. As shown in FIG. 6, in the wireless LAN antenna of the present invention, a certain point of the feeding electrode 33 with the feeding point FP is grounded to enable the antenna to be modified to the inverted F-type antenna. A grounded part on the feeding electrode 33 is called a ground point GP (도면도 수정). Even though a ground condition of a PCB in a set greatly varies, the impedance matching of the antenna and the variation of dual resonance frequencies can be easily performed by adjusting the distance between the feeding point FP and the ground point SP and the positions thereof.

The wireless LAN antenna of the present invention as described above is especially useful in implementing a diversity antenna employing two antennas for vertical polarization and horizontal polarization.

Figure 9:
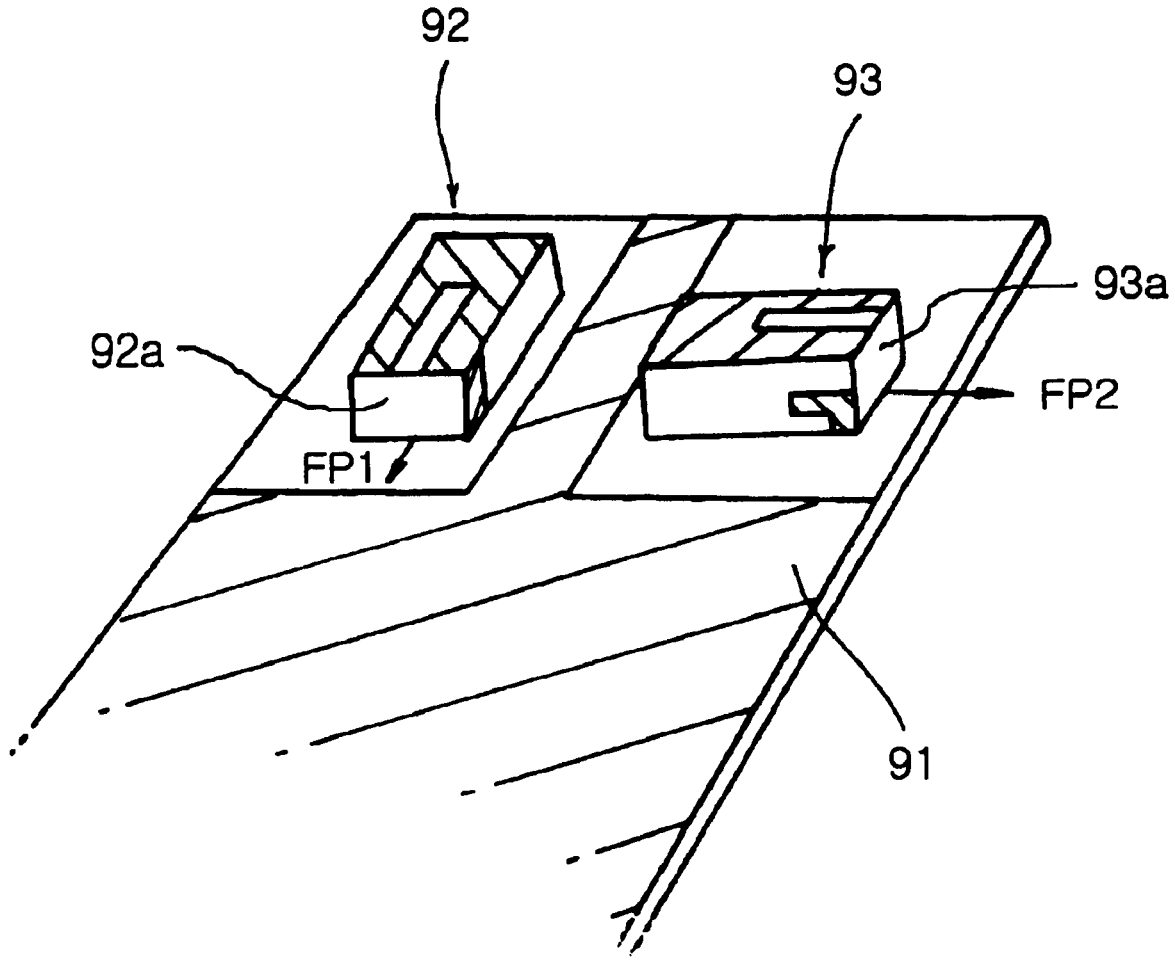
FIG. 9 is a view showing a state in which a diversity antenna implemented using the dual band wireless LAN antenna of the present invention is assembled.
Figure 10:
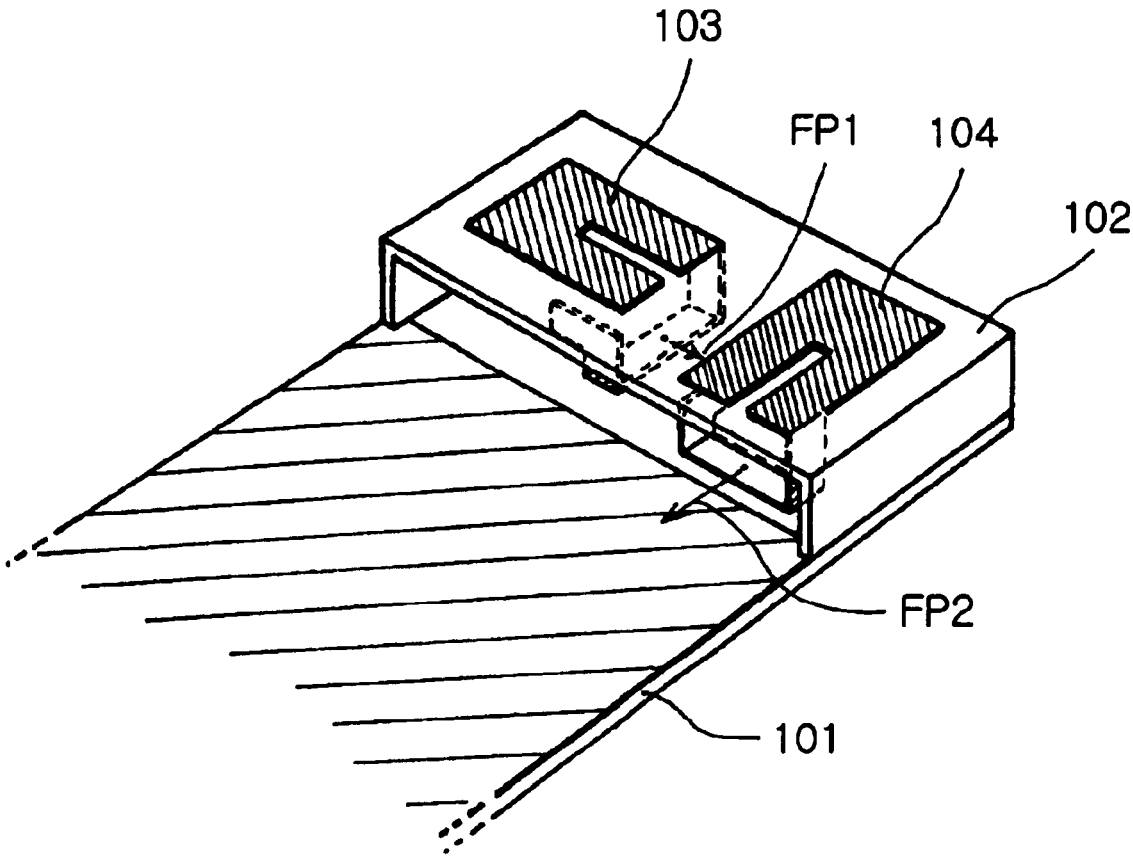
FIG. 10 is a view showing another state in which a diversity antenna implemented using the dual band wireless LAN antenna of the present invention is assembled.

FIGS. 9 and 10 are views showing embodiments of a diversity antenna implemented using the dual band wireless LAN antenna of the present invention in a wireless LAN card.

FIG. 9 shows a diversity antenna using the wireless LAN antenna of the present invention manufactured in a chip antenna type. In the diversity antenna, a first antenna 92 is attached onto a PCB 91 of the wireless LAN card in a vertical direction, and then a second antenna 93 is attached onto the PCB 91 in a direction orthogonal to the first antenna 92. At this time, the characteristics of the second antenna 93 may differ according to sets due to the interference with the first antenna 92. For this reason, antenna characteristics can be adjusted to obtain optimal characteristics by changing the position of a feeding point FP2 (that is, a point soldered with a pattern of the PCB) on the feeding electrode formed on a bottom surface of a dielectric block 93*a* is adjusted (삭제) before the second antenna 93 is soldered onto the PCB 91.

Similarly, antenna characteristics can be adjusted by changing the position of a feeding point FP1 of the first antenna 92.

FIG. 10 is a view showing another embodiment of a diversity antenna implemented using the wireless LAN antenna of the present invention. Referring to FIG. 10, an antenna support member 102 made of polymer or plastic is formed at a predetermined position of a PCB 101 on which a plurality of circuits and devices for processing RF LAN signals are mounted. Further, first and second antennas 103 and 104 formed according to the present invention are supported by the antenna support member 102 to be perpendicularly arranged.

In this case, radiation electrodes of the first and second antennas 103 and 104 are positioned on the top surface of the antenna support member 102, feeding electrodes thereof are positioned on the PCB 101, and certain points on the feeding electrodes are soldered with signal patterns and/or ground patterns.

The antenna support member 102 servers to support the first and second antennas 103 and 104 so that the radiation electrodes thereof are spaced apart from the PCB 101 by a certain height. The shape of the antenna support member 102 is not limited to a specific shape.

Further, the first and second antennas 103 and 104 are each implemented in such a way that a metal plate is formed by a press to have the above-described radiation electrode 31, the slot 32, the feeding electrode 33 and the matching electrode 34.

Further, even in the diversity antenna shown in FIG. 10, the feeding points of the first and second antennas 103 and 104 vary to adjust impedance as described above with reference to FIG. 9, thus minimizing an influence due to the interference between the first and second antennas 103 and 104.

As described above, the present invention provides a wireless LAN antenna and wireless LAN card with the same, which is formed in such a way that a radiation electrode and an open stub of a matching electrode are connected to each other on the basis of a feeding part, thus realizing superminiature and high performance of the antenna.

Further, the present invention is advantageous in that, since the wireless LAN antenna can adjust the impedance and resonance frequency of the antenna by varying only the position of feeding point without varying the length of electrodes, antenna characteristics can be adjusted through a simple method, thus reducing the antenna manufacturing costs.

Further, the present invention is advantageous in that, the structure of the antenna can freely vary from a monopole-type antenna to an inverted F-type antenna by only grounding a part of feeding electrode, and antenna characteristics can be simply adjusted by adjusting a distance between feeding and ground points and the positions thereof, thus promptly coping with the variation of sets.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wireless Local Area Network (LAN) antenna, comprising:

a radiation electrode having a predetermined area for defining at least one transmission/reception frequency band of the antenna;

a matching electrode having at least one open stub; and a feeding electrode having a feeding point formed at an arbitrary position of the feeding electrode to receive a current;

wherein said feeding electrode has a first end connected to the radiation electrode and a second end connected to the matching electrode; and the matching electrode has two inverted or reversed L-shaped open stubs which are connected, in parallel, to the feeding electrode.

2. A wireless Local Area Network (LAN) antenna, comprising:

a hexahedral dielectric block;

a radiation electrode formed on a top surface of the dielectric block to have a predetermined area and to define at least one transmission/reception frequency band of the antenna;

a matching electrode formed on a front surface of the dielectric block in an inverted or reversed L shape; and a feeding electrode formed on back and bottom surfaces of the dielectric block, wherein the feeding electrode has a feeding point formed on the bottom surface of the dielectric block, a first end connected to the radiation electrode, and a second end connected to the matching electrode.

3. A wireless Local Area Network (LAN) card, comprising:

a printed circuit board for mounting a plurality of semiconductor chips and devices to process RF LAN signals; and first and second antennas each comprising a radiation electrode having predetermined area for defining at least one transmission/reception frequency band of said antenna, said radiation electrode being printed on a top surface of a hexahedral dielectric block, a matching electrode having at least one open stub and being printed on a front surface of the dielectric block, and a feeding electrode having a first end connected to the radiation electrode and a second end connected to the matching electrode, said electrode being printed an back and bottom surfaces of the dielectric block;

wherein the first and second antennas are mounted on the printed circuit board to be perpendicularly arranged; and wherein impedance matching of the first and second antennas is adjustable by adjusting respective feeding points on the feeding electrodes of the antennas when the first and second antennas are mounted on the printed circuit board.

* * * * *